US011764508B2

(12) United States Patent
Li et al.

(10) Patent No.: US 11,764,508 B2
(45) Date of Patent: Sep. 19, 2023

(54) CONNECTION TERMINAL AND A CONNECTION ASSEMBLY

(71) Applicant: Tyco Electronics (Shanghai) Co. Ltd., Shanghai (CN)

(72) Inventors: Xinxin (Daisy) Li, Shanghai (CN); Liming (Eric) Wang, Shanghai (CN); Tongbao (Tim) Ding, Shanghai (CN); Zebin (Donnie) Tang, Shanghai (CN); Yang (Leon) Zou, Shanghai (CN)

(73) Assignee: Tyco Electronics (Shanghai) Co., Ltd., Shanghai (CN)

( * ) Notice: Subject to any disclaimer, the term of this patent is extended or adjusted under 35 U.S.C. 154(b) by 34 days.

(21) Appl. No.: 17/505,844

(22) Filed: Oct. 20, 2021

(65) Prior Publication Data

US 2022/0131312 A1 Apr. 28, 2022

(30) Foreign Application Priority Data

Oct. 23, 2020 (CN) ..... 202011145970.2

(51) Int. Cl.
*H01R 13/115* (2006.01)

(52) U.S. Cl.
CPC ..... *H01R 13/115* (2013.01)

(58) Field of Classification Search
None
See application file for complete search history.

(56) References Cited

U.S. PATENT DOCUMENTS 3,546,664 A * 12/1970 De Bolt ..... H01R 13/115 439/867
4,679,887 A * 7/1987 Jackson ..... H01R 13/20 439/849
5,106,324 A * 4/1992 Natsume ..... H01H 85/2035 439/512
6,095,873 A * 8/2000 Muramatsu ..... H01R 11/22 439/852

* cited by examiner

*Primary Examiner* — Ross N Gushi
(74) *Attorney, Agent, or Firm* — Barley Snyder

(57) ABSTRACT

A connection terminal for use with a plug-in terminal includes a terminal body and a tongue. The tongue extends from a first end of the terminal body along an axial direction of the connection terminal and defines a locking element. A first curled portion and a second curled portion are disposed oppositely on two sides of the terminal body. The first curled portion and the second curled portion define at least one first reinforcing rib and at least one second reinforcing rib, and include a first abutting portion and a second abutting portion. A plug-in space is formed between the first and second curled portions and the terminal body for receiving the plug-in terminal. With the plug-in terminal inserted into the plug-in space, the first abutting portion and the second abutting portion abut against the plug-in terminal, and the locking element locks the plug-in terminal within the plug-in space.

18 Claims, 3 Drawing Sheets

CONNECTION TERMINAL AND A CONNECTION ASSEMBLY

CROSS-REFERENCE TO RELATED APPLICATIONS

This application claims the benefit of Chinese Patent Application No. 202011145970.2 filed on Oct. 23, 2020, the whole disclosure of which is incorporated herein by reference.

FIELD OF THE INVENTION

The present invention relates to electrical connectors, and more particularly, to a quick-connect terminal for use in a connection assembly.

BACKGROUND

Quick-connect terminal assemblies are widely used to enable expedient electrical connections between two conductors, for example, two wires. The connector assembly typically includes a connection terminal and a plug-in terminal. The plug-in terminal may take the form of a blade-like male plug insertable into the connection terminal. The connection terminal generally includes a body having two curled portions arranged on either side thereof for defining a plug-in space sized to receive the plug-in terminal in a friction-fit manner.

Among the quick-connect terminals currently offered in the market, the curled portions are formed with a relatively large thickness in order to provide suitable strength. However, as the thickness of the curled portions increases, manufacturing costs rise. Conversely, a thinner or smaller curled portion thickness decreases the strength of the curl, and is unable to provide sufficient positive contact force. The lack of contact force applied on the plug-in terminal by the curled portions resulting in poor electrical contact.

Accordingly, there is a need for improved quick-connect terminals and associated assemblies which are cost effective to manufacture, as well as provide sufficient strength to maintain adequate and reliable electrical contact.

SUMMARY

According to an embodiment of the present disclosure, a connection terminal for use with a plug-in terminal includes a terminal body and a tongue. The tongue extends from a first end of the terminal body along an axial direction of the connection terminal and defines a locking element. A first curled portion and a second curled portion are disposed oppositely on two sides of the terminal body. The first curled portion and the second curled portion define at least one first reinforcing rib and at least one second reinforcing rib, respectively, and include a first abutting portion and a second abutting portion. A plug-in space is formed between the first and second curled portions and the terminal body for accommodating the plug-in terminal. With the plug-in terminal inserted into the plug-in space, the first abutting portion and the second abutting portion abut against the plug-in terminal, and the locking element locks the plug-in terminal within the plug-in space.

BRIEF DESCRIPTION OF THE DRAWINGS

The invention will now be described by way of example with reference to the accompanying Figures, of which.

DETAILED DESCRIPTION OF THE EMBODIMENTS

Figure 1:
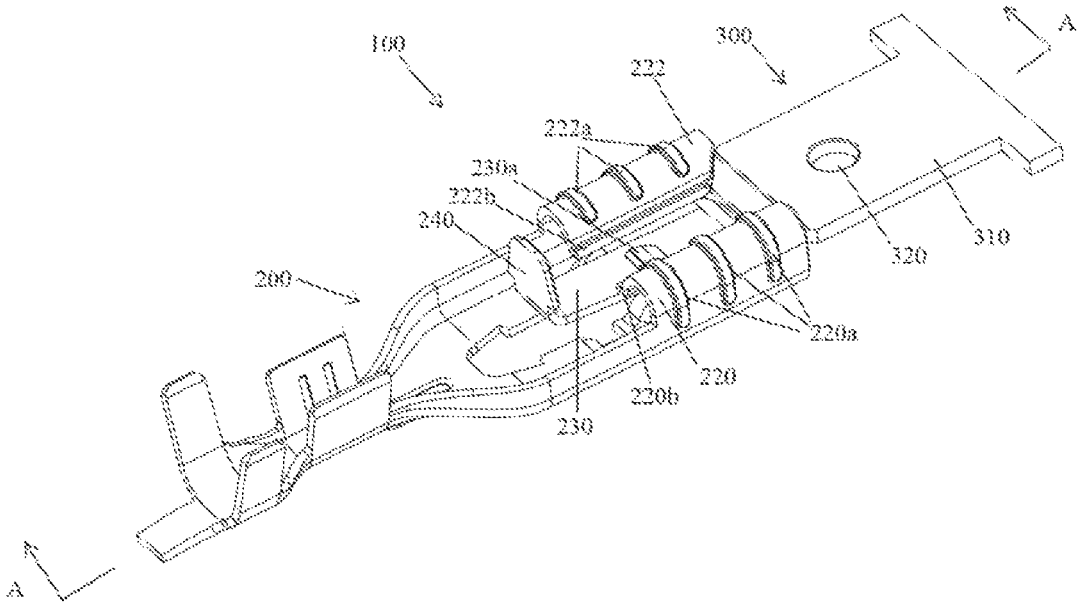
FIG. 1 is an exploded schematic diagram of a connection assembly according to an embodiment of the present invention.

Exemplary embodiments of the present disclosure will be described hereinafter in detail with reference to the attached drawings, wherein the like reference numerals refer to the like elements. The present disclosure may, however, be embodied in many different forms and should not be construed as being limited to the embodiment set forth herein; rather, these embodiments are provided so that the present disclosure will be thorough and complete, and will fully convey the concept of the disclosure to those skilled in the art.

In the following detailed description, for purposes of explanation, numerous specific details are set forth in order to provide a thorough understanding of the disclosed embodiments. It will be apparent, however, that one or more embodiments may be practiced without these specific details. In other instances, well-known structures and devices are schematically shown in order to simplify the drawing.

A connection terminal for use with a plug-in terminal according to an embodiment of the present disclosure includes a terminal body and a tongue. The tongue extends from a first end of the terminal body along the axial direction of the connection terminal and includes a locking portion. A first curl portion and a second curl portion are disposed oppositely on both sides of the terminal body. The first curl portion and the second curl portion are each provided with at least one first reinforcing rib and at least one second reinforcing rib. A plug-in space is formed between the first curl portion, the second curl portion and the terminal body for accommodating the plug-in terminal. The first curl portion and the second curl portion further include respective first abutting portions and second abutting portions. As the plug-in terminal is inserted into the plug-in space, the first abutting portion and the second abutting portion abut against the plug-in terminal, and the locking portion locks the plug-in terminal.

The embodiments of the present disclosure will be described in detail below with reference to the accompanying drawings. The front, back, left, right, top, bottom, front end, rear end, left end, right end, upper portion, bottom portion, left side, right side, longitudinal direction, transverse direction, etc. in the present invention are relative concepts used with reference to the orientation show in FIGS. 1 and 2.

Figure 5:
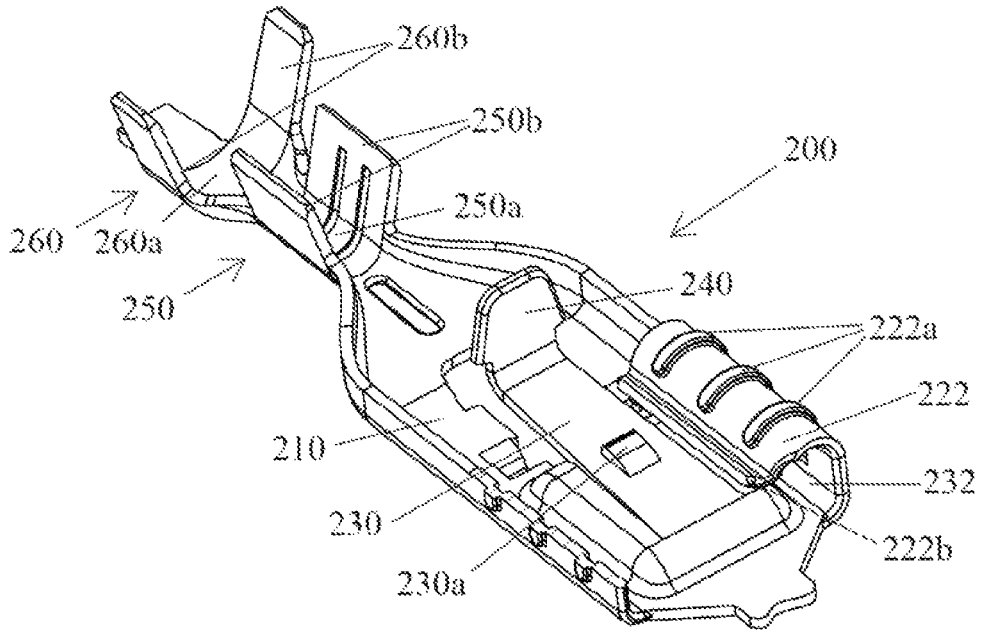
FIG. 5 is a partially cutout perspective view of the female terminal in FIG. 1.

As shown in FIGS. 1-6, the connection assembly 100 includes a connection terminal 200 (i.e., a female terminal) and a plug-in terminal 300 (i.e., a male terminal). The connection terminal 200 includes a terminal body 210, a first curl portion or curl 220 (also referred to as a curled arm) and a second curl portion or curl 222 (also referred to as a curled arm), and a tongue 230. The curl portion 220 and the curl portion 222 are formed by curling oppositely and inwardly from both sides of the terminal body 210. A plug-in space 232 is formed between the curl portions 220, 222 and the terminal body 210. Three reinforcing ribs 220*a* and three reinforcing ribs 222*a* are provided on the outer surfaces of the curl portions 220, 222. The reinforcing ribs 220*a*, 222*a* may be formed by stamping the curling portions 220, 222, such that they extend outwardly from the outer surfaces thereof, and define corresponding recesses on the inner surfaces of the curl portions, as shown in FIG. 5.

Figure 2:
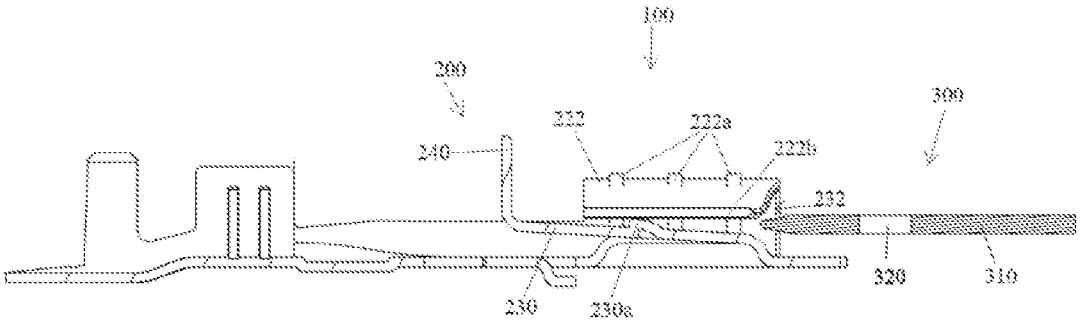
FIG. 2 is a cross-sectional view of the connection assembly of FIG. 1 taken along the A-A direction.

The curl portions 220, 222 further define abutting portions or projections 220*b*, 222*b* formed on free ends of the curl portions. As shown in FIG. 5, each abutting portion 220*b*, 22*b* defines a free end bent or extending in a direction opposite to a direction of curling of the curl portions 220, 222. It should be understood that in another implementation, the abutting portions 220*b*, 222*b* may be located at other suitable positions on the curl portions 220, 222. The tongue 230 extends from the right end of the terminal body 210 along the axial direction of the connection terminal 200, as shown in FIG. 1. The tongue 230 is provided with a locking portion 230*a*, such as a projection, as shown in FIGS. 1-5. The free end of the tongue 230 is bent upward to form an elastic unlocking portion or arm 240 for unlocking the plug-in terminal 300.

The plug-in terminal 300 includes a plug-in portion 310 and a through hole 320 formed on the plug-in portion. As the plug-in terminal 300 is inserted into the plug-in space 232, the abutting portions 220*b*, 222*b* respectively abut against the plug-in terminal and the locking portion 230*a* locks the plug-in terminal through the through hole 320. After the process of the assembly is finished, when the unlocking portion 240 is pressed down, it drives the locking portion 230*a* to move downward, such that the plug-in terminal 300 may be withdrawn from the plug-in space 232 of the connection terminal 200.

Figure 3:
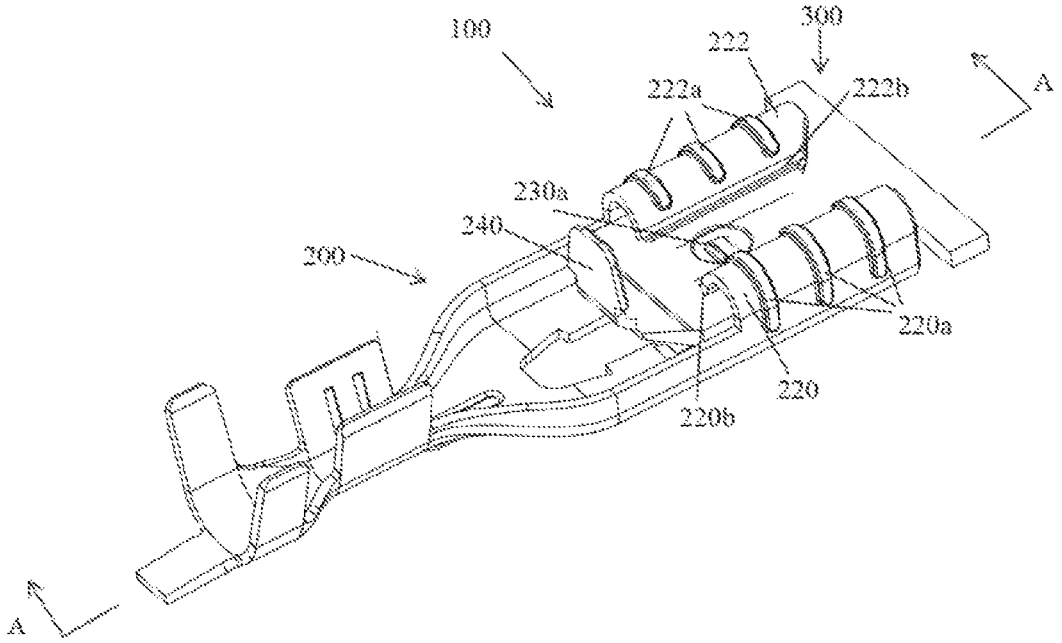
FIG. 3 is a schematic diagram of the connection assembly in FIG. 1 after being assembled.
Figure 4:
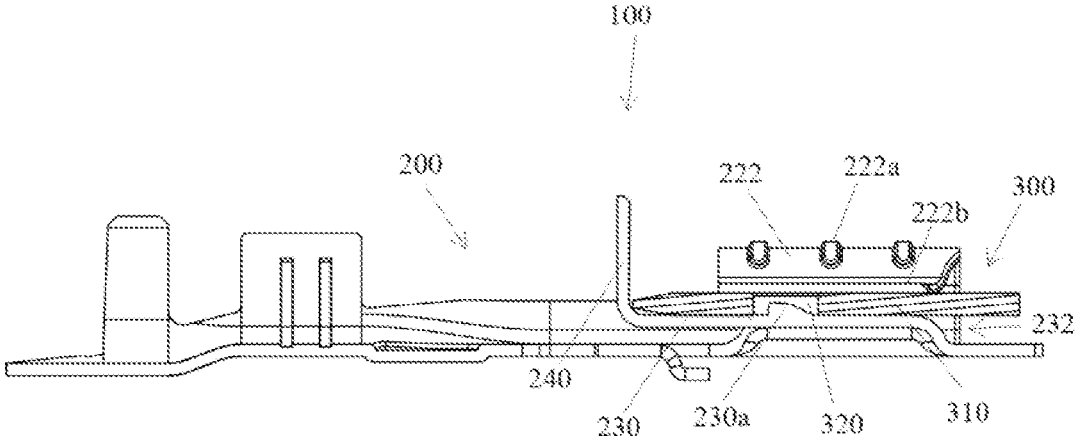
FIG. 4 is a cross-sectional view of the connection assembly of FIG. 3 taken along the A-A direction.

As shown in FIGS. 1 and 3, the reinforcing ribs 220*a*, 222*a* both extend in a direction at an angle of 90 degree with respect to the axial direction of the connection terminal 200. In another embodiment, the reinforcing rib 220*a* and the reinforcing rib 222*a* may extend in a direction at any suitable angle other than 90 degree to the axial direction of the connection terminal 200. In the embodiment shown in FIG. 1 and FIG. 3, the reinforcing rib 220*a* and the reinforcing rib 222*a* are arranged symmetrically with respect to the axial direction of the connection terminal 200. It should be understood that, while the illustrated embodiments include three reinforcing ribs 220*a*, 222*a* on each curl portion, the number of the reinforcing ribs may be one or two or more. In other embodiments, the number of the reinforcing ribs 220*a* and the number of reinforcing ribs 222*a* may be different. In another embodiment, the number of the reinforcing ribs 220*a* and the number of the reinforcing ribs 222*a* are the same, but the reinforcing ribs 220*a* and the reinforcing ribs 222*a* are arranged asymmetrically with respect to the axial direction of the connection terminal 200.

When the connection assembly 100 is assembled, the plug-in terminal 300 is inserted into the connection terminal 200. The locking portion 230*a* of the connection terminal 200 received within the through hole 320 of the plug-in terminal 300, and the plug-in portion 310 of the plug-in terminal abuts against the abutting portions 220*b* and 222*b* such that the plug-in portion of the plug-in terminal is locked on the connection terminal. When the plug terminal 300 needs to be detached from the connection terminal 200, the unlocking portion 240 is moved downward (for example, by manually pressing the unlocking portion) to drive the tongue 230 to deviate downward. This motion disengages the locking portion 230*a* from the through hole 320 of the plug-in terminal 300, and allows the plug-in terminal to withdraw from the plug-in space 232 of the connection terminal.

In the exemplary embodiment shown in FIGS. 1-6, the reinforcing rib 220*a* and the reinforcing rib 222*a* are provided on the outer surfaces of the curl portions 220, 222, respectively. However, in another embodiment, the reinforcing ribs 220*a* and 222*a* can be arranged on the inner surfaces of the curl portions 220, 222 while realizing the same improved performance, with the rest of the structures remaining the same as those of the embodiment shown in FIGS. 1-6.

Figure 6:
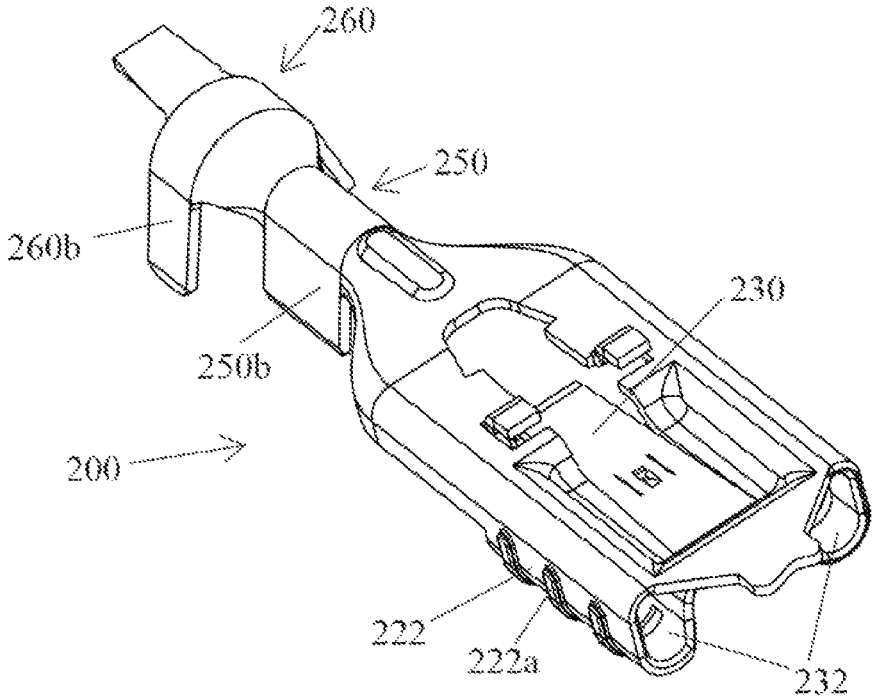
FIG. 6 is a bottom view of the female terminal of FIG. 5.

As shown in FIGS. 5 and 6, the connection terminal 200 further includes a wire connection portion 250 and a pair of side crimping arms 250*a*, 250*b* provided on the left and right sides of the terminal body 210 for securing an exposed conductive wire to the terminal. The connection terminal 200 further includes a wire fixing portion 260, which includes a fixing portion body 260*a* and a pair of fixing pieces or crimping arms 260*b*, wherein the fixing pieces 260*b* are bent to fix an insulated portion of a wire to the fixing portion body.

It should be appreciated for those skilled in this art that the above embodiments are intended to be illustrated, and not restrictive. For example, many modifications may be made to the above embodiments by those skilled in this art, and various features described in different embodiments may be freely combined with each other without conflicting in configuration or principle.

Although several exemplary embodiments have been shown and described, it would be appreciated by those skilled in the art that various changes or modifications may be made in these embodiments without departing from the principles and spirit of the disclosure, the scope of which is defined in the claims and their equivalents.

As used herein, an element recited in the singular and proceeded with the word "a" or "an" should be understood as not excluding plural of said elements or steps, unless such exclusion is explicitly stated. Furthermore, references to "one embodiment" of the present disclosure are not intended to be interpreted as excluding the existence of additional embodiments that also incorporate the recited features. Moreover, unless explicitly stated to the contrary, embodiments "comprising" or "having" an element or a plurality of elements having a particular property may include additional such elements not having that property.

What is claimed is:

1. A connection terminal for use with a plug-in terminal, comprising:

a terminal body; and a first curl portion and a second curl portion arranged oppositely on two lateral sides of the terminal body, the first curl portion has a plurality of first reinforcing ribs identical to one another and the second curl portion has a plurality of second reinforcing ribs identical to one another the first and second curl portions and the terminal body defining a plug-in space therebetween for receiving the plug-in terminal inserted in an axial direction of the connection terminal, the first curl portion and the second curl portion including a respective first abutting portion and second abutting portion for electrically contacting the plug-in terminal arranged within the plug-in space.

2. The connection terminal according to claim 1, wherein the first reinforcing ribs and the second reinforcing ribs are disposed on outer surfaces of the first curl portion and the second curl portion, respectively.

3. The connection terminal according to claim 1, wherein the first reinforcing ribs and the second reinforcing ribs all extend at a predetermined non-zero angle with respect to the axial direction of the connection terminal.

4. The connection terminal according to claim 3, wherein the predetermined non-zero angle is 90 degrees.

5. The connection terminal according to claim 1, wherein the first reinforcing ribs and the second reinforcing ribs are arranged symmetrically with respect to the axial direction of the connection terminal.

6. The connection terminal according to claim 1, wherein a spacing between the plurality of reinforcing ribs on the first and second curl portions is uniform in the axial direction of the connection terminal.

7. The connection terminal according to claim 1, further comprising a tongue extending from a first end of the terminal body along the axial direction of the connection terminal and defining a locking element adapted to engage with the plug-in terminal for locking the plug-in terminal within the plug-in space.

8. The connection terminal according to claim 7, wherein the locking element comprises a locking protrusion defined on the tongue and arranged between the first curl portion and the second curl portion in a lateral direction of the connection terminal.

9. The connection terminal according to claim 7, wherein the tongue further comprises an unlocking arm for unlocking the plug-in terminal.

10. The connection terminal according to claim 9, wherein the unlocking arm is defined on a free end of the tongue, the tongue and unlocking arm being elastically movable in a direction transverse to an insertion direction of the plug-in terminal.

11. The connection terminal according to claim 1, wherein the first curl portion and the second curl portion are formed by curling the two lateral sides of the terminal body oppositely and inwardly, respectively, and free ends of the first curl portion and the second curl portion define the first abutting portion and the second abutting portion.

12. The connection terminal according to claim 11, wherein each abutting portion defines a free end bent in a direction opposite to a direction of curling of the curl portion.

13. A connector assembly, comprising:

a plug-in terminal; and a connection terminal including:

a terminal body;

a tongue extending from a first end of the terminal body along an axial direction of the connection terminal and defining a locking portion; and a first curl portion and a second curl portion arranged oppositely on two lateral sides of the terminal body, the first curl portion has a plurality of first reinforcing ribs identical to one another and the second curl portion has a plurality of second reinforcing ribs identical to one another, the first and second curl portions and the terminal body defining a plug-in space therebetween for receiving the plug-in terminal inserted in an axial direction of the connection terminal, the first curl portion and the second curl portion including a respective first abutting portion and a second abutting portion for electrically contacting the plug-in terminal arranged within the plug-in space.

14. The connector assembly according to claim 13, wherein the first reinforcing ribs and the second reinforcing ribs protrude from respective outer surfaces of the first curl portion and the second curl portion, respective inner surfaces of the first curl portion and the second curl portion defining recesses corresponding to the first and second reinforcing ribs.

15. The connector assembly according to claim 13, wherein the first reinforcing ribs and the second reinforcing ribs extend perpendicularly with respect to the axial direction.

16. The connector assembly according to claim 13, wherein first reinforcing ribs and the second reinforcing ribs are arranged symmetrically with respect to the axial direction.

17. The connector assembly according to claim 13, wherein first portions of the two lateral sides of the terminal body extend normally from the terminal body, the first curl portion and the second curl portion are formed by curling second portions of the two lateral sides oppositely and inwardly.

18. A connection terminal for use with a plug-in terminal, comprising:

a terminal body; and a first curled arm and a second curled arm arranged oppositely on two lateral sides of the terminal body, the curled arms and the terminal body defining a plug-in space for receiving the plug-in terminal, each of the first curled arm and the second curled arm including:

a plurality of reinforcing ribs identical to one another and extending between the lateral side of the terminal body and an end of the curled arm; and an abutting portion extending from the end of the curled arm for electrically contacting the plug-in terminal arranged within the plug-in space.

* * * * *